US010467895B2

(12) United States Patent
Nordbruch

(10) Patent No.: US 10,467,895 B2
(45) Date of Patent: Nov. 5, 2019

(54) DEVICE AND METHOD FOR OPERATING A PARKING FACILITY

(71) Applicant: Robert Bosch GmbH, Stuttgart (DE)

(72) Inventor: Stefan Nordbruch, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/514,965

(22) PCT Filed: Sep. 29, 2015

(86) PCT No.: PCT/EP2015/072363

§ 371 (c)(1),
(2) Date: Mar. 28, 2017

(87) PCT Pub. No.: WO2016/066360

PCT Pub. Date: May 6, 2016

(65) Prior Publication Data

US 2018/0233033 A1 Aug. 16, 2018

(30) Foreign Application Priority Data

Oct. 27, 2014 (DE) ..... 10 2014 221 764

(51) Int. Cl.

*G08G 1/015* (2006.01)
*G08G 1/04* (2006.01)
*G08G 1/14* (2006.01)

(52) U.S. Cl.

CPC ..... *G08G 1/015* (2013.01); *G08G 1/04* (2013.01); *G08G 1/143* (2013.01); *G08G 1/144* (2013.01); *G08G 1/146* (2013.01); *G08G 1/149* (2013.01)

(58) Field of Classification Search

CPC ..... B60R 25/305; G07B 15/02

(Continued)

(56) References Cited

U.S. PATENT DOCUMENTS 7,123,166 B1 * 10/2006 Haynes ..... G08G 1/14 340/932.2
7,957,900 B2 * 6/2011 Chowdhary ..... G06Q 10/087 340/426.15

(Continued)

FOREIGN PATENT DOCUMENTS

DE 102009029720 A1 12/2010
EP 2500888 A1 9/2012

(Continued)

OTHER PUBLICATIONS

International Search Report dated Nov. 27, 2015, of the corresponding International Application PCT/EP2015/072363 filed Sep. 29, 2015.

*Primary Examiner* — Emily C Terrell
(74) *Attorney, Agent, or Firm* — Norton Rose Fulbright US LLP; Gerard Messina

(57) ABSTRACT

A device for operating a parking facility, including a database in which one or multiple vehicle property/properties is/are stored for different vehicle types, and a processor which is designed to ascertain a type of a vehicle based on the recorded image of the vehicle and to read the vehicle property/properties corresponding to the ascertained vehicle type out of the database, the processor being further designed to ascertain a parking position for the vehicle in the parking facility based on the one or multiple read-out vehicle property/properties. A method for operating a parking facility, a parking system for vehicles, and a computer program are also described.

8 Claims, 2 Drawing Sheets

(58) Field of Classification Search
USPC ..... 340/932.2
See application file for complete search history.

(56) References Cited

U.S. PATENT DOCUMENTS

| | | | | |
|---|---|---|---|---|
| 9,589,468 | B2 * | 3/2017 | Gupta | G08G 1/146 |
| 2005/0207876 | A1 * | 9/2005 | Springwater | E04H 6/24 414/231 |
| 2005/0280555 | A1 * | 12/2005 | Warner, IV | G08G 1/14 340/932.2 |
| 2006/0250278 | A1 * | 11/2006 | Tillotson | G08G 1/14 340/932.2 |
| 2012/0072067 | A1 * | 3/2012 | Jecker | B62D 15/0285 701/25 |
| 2012/0092192 | A1 * | 4/2012 | Wong | G08G 1/04 340/932.2 |
| 2013/0222157 | A1 | 8/2013 | Fukushima | |
| 2014/0145862 | A1 * | 5/2014 | Wang | G08G 1/141 340/932.2 |
| 2014/0266802 | A1 * | 9/2014 | Love | G08G 1/144 340/932.2 |
| 2015/0302742 | A1 * | 10/2015 | Schuller | G08G 1/017 340/933 |
| 2016/0027302 | A1 * | 1/2016 | Gupta | G08G 1/146 340/932.2 |

FOREIGN PATENT DOCUMENTS

| | | | | |
|---|---|---|---|---|
| EP | 2712762 | A1 | 4/2014 | |
| GB | 2552020 | A * | 1/2018 | B62D 15/027 |
| JP | H09-91591 | A | 4/1997 | |
| JP | 2007-025889 | A | 2/2007 | |
| JP | 2013527960 | A | 7/2013 | |
| WO | 2004042673 | A2 | 5/2004 | |
| WO | 2008061540 | A1 | 5/2008 | |
| WO | 2011138035 | A1 | 11/2011 | |
| WO | 2012125687 | A2 | 9/2012 | |

* cited by examiner

DEVICE AND METHOD FOR OPERATING A PARKING FACILITY

FIELD

The present invention relates to a device and a method for operating a parking facility. The present invention further relates to a parking system for vehicles and a computer program.

BACKGROUND INFORMATION

In a fully automated (autonomous), so-called valet parking system, a vehicle is parked by its driver at a drop-off position, for example in front of a parking garage, and from there the vehicle drives itself into a parking position/parking space and back again to the drop-off position.

German Patent Application No. DE 10 2009 029 720 A1 describes a system which completely measures a vehicle prior to a parking process using a camera system or an optical scanning system. Thus, a dimension of the vehicle is detected in order to be able to accommodate the vehicle in one of the parking areas in an optimally space saving way.

This type of measurement must be carried out with great precision in order to be able to facilitate the optimal space-saving accommodation. Thus, such a system is generally very complex and cost intensive.

Japan Patent Application No. JP 2007-025889 describes a parking management system, a vehicle being photographed prior to parking. A model of the vehicle is determined based on the photo. A parking space is ascertained for the vehicle corresponding to the determined model.

SUMMARY

An object of the present invention is to provide a device for operating a parking facility which facilitates an optimal accommodation for the vehicle in the parking facility.

An object of the present invention is also to provide a corresponding method for operating a parking facility.

An object of the present invention is furthermore to provide a corresponding parking system for vehicles.

An object of the present invention is also to provide a corresponding computer program.

Advantageous embodiments of the present invention are described herein.

According to one aspect of the present invention, a device is provided for operating a parking facility, including, for example:

- a database in which one or multiple vehicle property/properties is/are stored for different vehicle types,
- a processor which is designed to ascertain a type of the vehicle based on a recorded image of the vehicle, and
- to read the vehicle property/properties corresponding to the ascertained vehicle type out of the database,
- the processor being additionally designed to ascertain a parking position for the vehicle in a parking facility based on the read-out vehicle property/properties.

According to another aspect, a method is provided for operating a parking facility,

- a type of the vehicle being ascertained based on a recorded image of the vehicle,
- one or multiple vehicle properties corresponding to the ascertained vehicle type being read out of a database, in which one or multiple vehicle property/properties is/are stored for different vehicle types, and

- a parking position for the vehicle in the parking facility being ascertained based on the one or multiple read-out vehicle properties.

According to another aspect, a parking system is provided for vehicles, the parking system including a parking facility which has one or multiple parking positions, the parking system including the device according to the present invention for operating a parking facility.

According to another aspect, a computer program is provided which includes program code for carrying out the method according to the present invention for operating a parking facility when the computer program is executed on a computer.

The present invention also includes ascertaining a parking position for the vehicle in the parking facility based on vehicle properties which are read out of a database. Multiple vehicle properties for different vehicle types are stored in this database. In order to now specifically ascertain the type of the vehicle that intends to park in the parking facility, it is provided according to the present invention to use a recorded image of the vehicle for this purpose. Advantageously, in contrast to German Patent Application No. DE 10 2009 029 720 A1, no highly complex and cost-intensive measuring system is required. It is generally technically simpler and less expensive to record a simple photo or an image of the vehicle. This image is used to ascertain the type of the vehicle. Thus, a simple and efficient concept is advantageously provided which facilitates the ascertainment of an optimal parking position for the vehicle based on vehicle properties of the vehicle.

In this context, it is merely described Japan Patent Application No. JP 2007-025889, that the model of the vehicle is determined based on the photo, a parking position for the vehicle being ascertained for the determined model. According to the present invention hereby differs in particular in that a database is provided, as defined in light of this description. According to the present invention, the vehicle properties are read out of this database. The recorded image is merely used to ascertain the type of the vehicle.

According to one specific embodiment it is provided that the vehicle properties are elements selected from the following group of vehicle properties: dimensions of the vehicle, charging time for a vehicle battery, wheelbase, potential driving trajectories in the parking facility.

Dimensions of the vehicle include in particular a height and/or a width and/or a length and/or a contour of the vehicle. A charging time for a vehicle battery corresponds in particular to a charging time of a vehicle battery of an electric motor. This means, in particular that a vehicle property may be a charging time for electric vehicles. This means that, for example, the parking position is ascertained using a contour of the vehicle. For example, a VW bus may not park in a parking position which has a lower height in the front area than in a rear area. A limousine might park there.

In another specific embodiment, an optical detection device is provided which is designed to optically detect a vehicle in order to record an image of the vehicle. Thus, this yields the technical advantage in particular that an image of the vehicle may be recorded. The optical detection device includes in particular one or multiple camera(s).

According to another specific embodiment it is provided that the processor is designed to compare the recorded image to reference images of different vehicles to ascertain the vehicle type based on the comparison. Thus, this yields the technical advantage in particular that a simple ascertainment of the vehicle type is achieved. The comparison includes, for example, pattern recognition.

According to one specific embodiment, the reference images are stored in the database.

In another specific embodiment, a communication interface is provided.

The communication interface is designed, according to one specific embodiment, to transmit the ascertained parking position to a user of a communication network via the communication network. The user is, for example, a mobile telephone or a vehicle.

The communication interface is designed, according to one specific embodiment, to receive a parking request for a vehicle from a user of a communication network via the communication network, the parking request including one or multiple vehicle property/properties of the vehicle, the processor being designed to compare the one or multiple received vehicle property/properties with the read-out vehicle property/properties; in the case of a deviation, the communication interface being designed to transmit a response informing the user about the deviation via the communication network.

Thus, this yields the technical advantage in particular that the user of the communication network is informed that there are deviations between the vehicle properties transmitted by him/her and the read-out vehicle properties. He/she may thus correspondingly adjust the reservation. In particular, the processor is designed to correspondingly adjust the reservation.

In another specific embodiment it is provided that the processor is designed to ascertain a travel route in the parking facility to the parking position for the vehicle based on the read-out vehicle property/properties. Thus, this yields the technical advantage in particular that the vehicle may drive, in particular may autonomously drive, to the parking position depending on the ascertained travel route. The travel route leads, for example, from a start position to a destination position and preferably back again. A start position is, for example, a drop-off position (compare the explanations further below) and a destination position is, for example, a parking position (compare the explanations further below) or vice versa.

The route calculation or the ascertainment of the travel route is based, in particular, on a check as to whether the ascertained parking position, is optimal, for example, relative to an occupancy of the parking facility, may actually be approached by the vehicle. Thus, it is checked, in particular during the route calculation whether the vehicle may drive to and pull into the parking position respectively, for example, using its wheelbase and/or controllers and/or sensors.

According to one specific embodiment it is provided that the communication interface is designed to transmit the ascertained travel route to the user of the communication network via the communication network.

Functionalities of the method result similarly from the functionalities of the device and vice versa.

According to one specific embodiment, the device is configured to execute or carry out the method according to the present invention for operating a parking facility.

This means, in particular, that method features arise from the corresponding device features and vice versa.

A parking facility within the sense of the present invention may also be referred to as a parking area and is used as a parking area for vehicles. The parking facility thus forms in particular a contiguous area that has multiple parking spaces (with respect to a parking facility on private property) or parking positions (with respect to a parking facility on public property). The parking facility may include a parking deck according to one specific embodiment. In particular, the parking facility includes a parking garage.

A drop-off position within the sense of the present invention is a position at which a driver of the vehicle may stop his/her vehicle for an autonomous parking process and from which he/she may pick up his/her vehicle again at a later point in time.

A parking position within the sense of the present invention is a position at which the vehicle is to autonomously park.

In one specific embodiment, the vehicle autonomously navigates from the drop-off position to the parking position.

In another specific embodiment, the vehicle autonomously pulls into the parking position.

In another specific embodiment, the vehicle autonomously pulls out of the parking position.

According to another specific embodiment, the vehicle autonomously navigates from the parking position to the drop-off position.

According to one specific embodiment, the communication network includes a WLAN network and/or a mobile network.

Autonomous within the sense of the present invention means, in particular, that the vehicle navigates independently, thus without any intervention by a driver. The vehicle thus drives autonomously in the parking facility without requiring a driver to steer the vehicle for this purpose. This means, in particular, that a guiding device for the navigation is provided which autonomously guides the vehicle. Guiding includes in particular a transverse and/or a longitudinal guidance of the vehicle. Such an autonomously driving vehicle, which may automatically pull into and out of a parking position, is referred to, for example, as an AVP vehicle. AVP stands for "automatic valet parking" and may be referred to as an automatic parking process. Vehicles, which do not have this AVP function, are referred to, for example, as normal vehicles.

A parking facility management system coordinates, in particular, an assignment of the parking positions and transfers the necessary information (for example, a digital map of the parking facility), for example, to the autonomous vehicles.

The present invention is explained in greater detail based on preferred exemplary embodiments.

BRIEF DESCRIPTION OF EXAMPLE EMBODIMENTS

DETAILED DESCRIPTION OF EXAMPLE EMBODIMENTS

Figure 1:
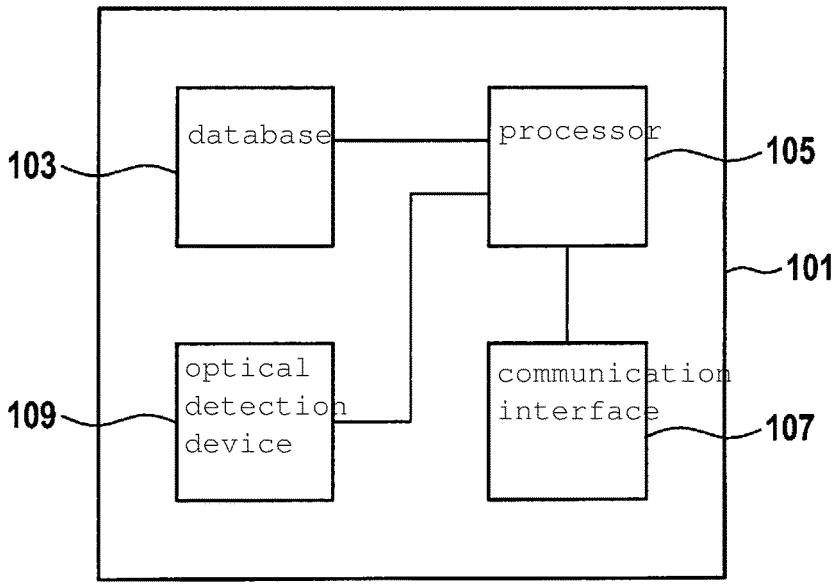
FIG. 1 shows a device for operating a parking facility.

FIG. 1 shows a device 101 for operating a parking facility.

Device 101 includes a database 103 in which one or multiple vehicle property/properties is/are stored for different vehicle types. For example, dimensions for different vehicle types are stored in database 103.

Device 101 further includes a processor 105 which is designed to ascertain a type of a vehicle based on a recorded image of the vehicle. Processor 105 is further designed to read out vehicle properties corresponding to the ascertained vehicle type from database 103.

Reading out within the sense of the present invention includes in particular a query on the part of processor 105 to database 103 and a response from database 103 to processor 105 corresponding to the query. Processor 105 and database 103 communicate with one another, for example, via the communication network.

Processor 105 is further designed to ascertain a parking position for the vehicle in the parking facility based on the read-out vehicle property/properties.

Device 101 further includes a communication interface 107 which is designed to transmit the ascertained parking position to a vehicle.

Device 101 further includes an optical detection device 109 which is designed to detect the vehicle optically in order to record an image of the vehicle. This means that the image of the vehicle recorded with the aid of optical detection device 109 is transferred to processor 105 which determines the type of the vehicle based on the recorded image.

It is provided, in particular, that the processor compares the recorded image with reference images of different vehicle types in order to ascertain the vehicle type based on the comparison. The comparison includes, in particular, pattern recognition.

Figure 2:
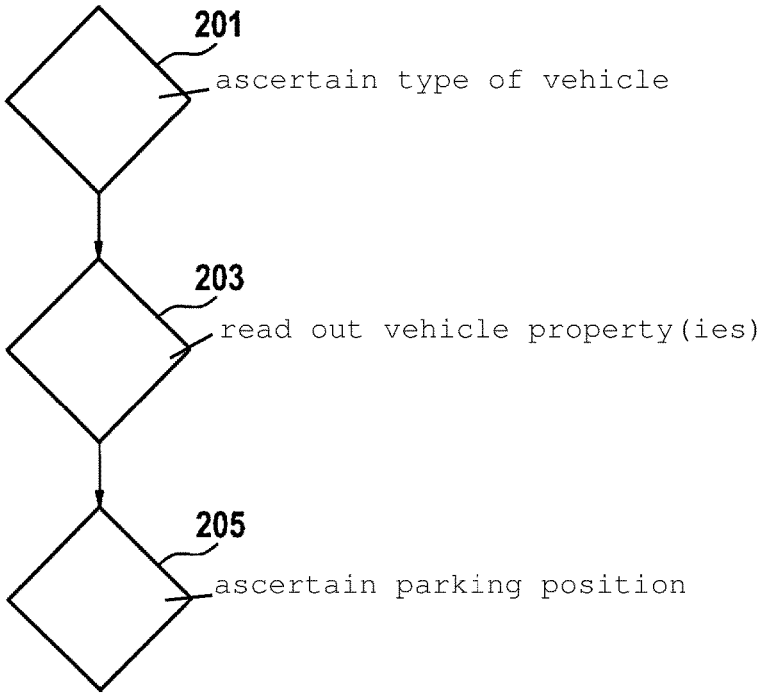
FIG. 2 shows a method for operating a parking facility.

FIG. 2 shows a flow chart of a method for operating a parking facility.

The method is carried out, for example on device 101 of FIG. 1.

According to a step 201, a type of the vehicle is ascertained based on a recorded image of the vehicle. In a step 203, one or multiple vehicle property/properties corresponding to the ascertained vehicle type are read out of a database in which one or multiple vehicle property/properties for different vehicle types is/are stored. In a step 205 it is provided that a parking position is ascertained for the vehicle in the parking facility based on the read-out vehicle property/properties. It is provided, in particular, that the ascertained parking position is transmitted to the vehicle, in particular, via a communication network.

Figure 3:
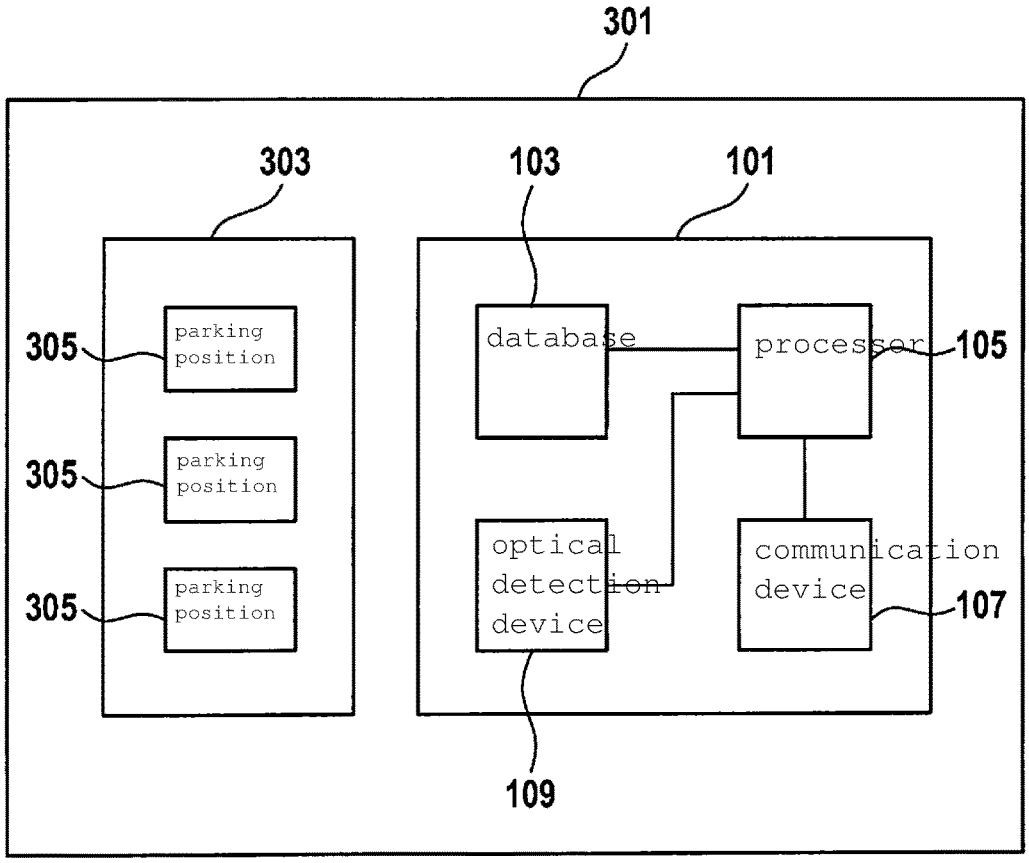
FIG. 3 shows a parking system for vehicles.

FIG. 3 shows a parking system 301 for vehicles.

Parking system 301 includes a parking facility 303. Parking facility 303 includes multiple parking positions 305. Parking system 301 further includes device 101 from FIG. 1.

In summary, the present invention provides, in particular, an efficient concept which facilitates an optimal occupation of the parking positions of a parking facility. Thus, it may be achieved, in particular in an advantageous way, that a small vehicle, for example, a Smart car, may be parked in a correspondingly small parking position/parking space and a larger vehicle, for example, a BMW7 or a Mercedes S-class may be parked in a correspondingly larger parking position/parking space.

Furthermore, damage to the vehicle may be advantageously prevented during driving to the parking position and during pulling into the parking position/parking space, for example, because a ceiling height is not sufficient for the vehicle. It is provided, in particular, according to the present invention that the dimensions of the vehicle are read out of a database, the parking position for the vehicle then being ascertained based on the dimensions of the vehicle.

Furthermore, it is advantageously facilitated and preferably provided that the vehicle properties, in particular the dimensions, of the vehicle may have, or respectively have, an influence on a pricing for parking in the parking facility.

As the database, from which corresponding vehicle properties are read out based on the ascertained vehicle type, is provided according to the present invention, it is thus not absolutely necessary for the vehicle properties to be already transmitted to the device or to the parking system prior to the actual parking process. Thus, spontaneous visits to the parking facility are also advantageously possible.

The underlying basis according to the present invention includes in particular that the vehicle is not measured, in particular optically measured, but instead the vehicle, respectively the vehicle type, is recognized or ascertained based on a photo or an image, in particular, with the aid of a comparison of reference images or reference photos, which are likewise stored in the database according to one specific embodiment, so that the vehicle properties, in particular the vehicle dimensions, may be read out of the database.

A parking process may be carried out according to one specific embodiment as follows:

The vehicle is stopped at the dropping zone or drop-off position. Device 101 takes one or multiple photos or images of the vehicle with the aid of optical detection device 109, for example from one side of the vehicle. In particular, exclusively one photo of the vehicle is recorded.

Such a photo may hereby be recorded with the aid of a relatively simple and cheap camera. Advantageously, no technically expensive camera system is required.

Device 101, in particular processor 105, compares the vehicle in the photo or in the image to photos or images from database 103 and correspondingly ascertains the type of the vehicle.

Processor 103 then reads the corresponding vehicle properties out of database 103. In addition to vehicle dimensions, in particular, additional data, for example a charging time for electric vehicles, may be filed and saved or stored in database 103. Processor 103 compares the vehicle properties with previously transmitted vehicle properties if necessary, if they were transmitted to device 101 within the context of a reservation request or parking request. In the case of deviations, it informs a driver/reserver of the vehicle about required changes, if necessary.

Differences may thus arise, for example, that accessories or extensions on the vehicle, for example, bicycle carriers or roof boxes, are installed which changes the properties of the recognized vehicle, for example, the height.

Differences may thus arise, for example, in that a driver arrives with another vehicle at the parking facility than was originally registered or reserved. For example, the driver had registered with an Audi A8, but arrives in a BMW 1.

Changes may thus arise based on such differences.

Processor 105 ascertains, in particular, an optimal parking space for the vehicle. Optimal means here, in particular, with respect to the selected vehicle properties, such as, for example, the dimensions of the vehicle and/or the path to be traveled. Device 101 transmits the parking position/parking space to the vehicle with the aid of communication interface 107.

Subsequently, the autonomous parking process (also known as automatic valet parking) may then be started. In general, the concept according to the present invention may also be used for "normal" valet parking. Normal valet parking refers to parking by human personnel.

The advantage over conventional systems and methods includes, in particular, in that according to one specific embodiment according to the present invention, only one camera or one optical scanning system is required, which may be designed much more simply and is, thus, cheaper. Furthermore, this type of "measurement" (thus, reading vehicle properties out of the database), is much more precise, since the original data from the manufacturer of the vehicles may be used. Furthermore, additional data, for example a charging time for electric vehicles, may be advantageously ascertained or read out of the database.

What is claimed is:

1. A device for operating a parking facility, comprising:
a computer system, including:
a computer database in which at least one vehicle property for each of different vehicle types is stored; and
a processor configured to perform the following:
ascertaining a type of a vehicle based on a recorded image of the vehicle;
reading the vehicle property corresponding to the ascertained vehicle type out of the computer database; and
ascertaining an optimal parking position for the vehicle in the parking facility based on the read-out vehicle property;
wherein the vehicle property includes dimensions of the vehicle and a wheelbase of the vehicle, and at least one of the following: a charging time for a vehicle battery, and possible driving trajectories in the parking facility;
wherein the optimal parking spot is optimal with respect to the vehicle properties, including the dimensions of the vehicle and the path to be traveled, and
wherein the path to be traveled is represented by the possible driving trajectories in the parking facilities.

2. The device as recited in claim 1, further comprising:
an optical detection device to optically detect a vehicle to record an image of the vehicle.

3. The device as recited in claim 1, wherein the processor is configured to compare the recorded image with reference images of different vehicles to ascertain the vehicle type based on the comparison.

4. The device as recited in claim 1, further comprising:
a communication interface configured to receive a parking request for a vehicle from a user of a communication network via the communication network, the parking request at least one vehicle property of the vehicle, the processor configured to compare the received vehicle property with the read-out vehicle property, and the communication interface configured, in the case of a deviation, to transmit a response informing the user about the deviation via the communication network.

5. The device as recited in claim 1, wherein the processor is configured to ascertain a travel route for the vehicle to the parking position in the parking facility based on the read-out vehicle property.

6. A method for operating a parking facility, the method comprising:
ascertaining, via a processor, a type of a vehicle based on a recorded image of the vehicle;
reading out, via the processor, from a database at least one vehicle property corresponding to the ascertained vehicle type, the database storing at least one vehicle property of each of different vehicle types; and
ascertaining, via the processor, an optimal parking position for the vehicle in the parking facility based on the read-out vehicle property, wherein the vehicle property includes dimensions of the vehicle and a wheelbase of the vehicle, and at least one of the following: a charging time for a vehicle battery, and possible driving trajectories in the parking facility;
wherein the optimal parking spot is optimal with respect to the vehicle properties, including the dimensions of the vehicle and the path to be traveled, and
wherein the path to be traveled is represented by the possible driving trajectories in the parking facilities.

7. A parking system for vehicles, comprising:
a parking facility which includes at least one parking position; and
a device for operating the parking facility:
a computer database in which at least one vehicle property for each of different vehicle types is stored; and
a processor configured to ascertain a type of a vehicle based on a recorded image of the vehicle, read the vehicle property corresponding to the ascertained vehicle type out of the database, and ascertain an optimal parking position for the vehicle in the parking facility based on the read-out vehicle property, wherein the vehicle property includes dimensions of the vehicle and a wheelbase of the vehicle, and at least one of the following: a charging time for a vehicle battery, and possible driving trajectories in the parking facility;
wherein the optimal parking spot is optimal with respect to the vehicle properties, including the dimensions of the vehicle and the path to be traveled, and
wherein the path to be traveled is represented by the possible driving trajectories in the parking facilities.

8. A non-transitory computer-readable storage medium on which is stored a computer program, which is executable by a processor, comprising:
a program code arrangement having program code for operating a parking facility, by performing the following:
ascertaining, via the processor, a type of a vehicle based on a recorded image of the vehicle;
reading out, via the processor, from a database at least one vehicle property corresponding to the ascertained vehicle type, the database storing at least one vehicle property of each of different vehicle types; and
ascertaining, via the processor, an optimal parking position for the vehicle in the parking facility based on the read-out vehicle property wherein the vehicle property includes dimensions of the vehicle and a wheelbase of the vehicle, and at least one of the following: a charging time for a vehicle battery, and possible driving trajectories in the parking facility;
wherein the optimal parking spot is optimal with respect to the vehicle properties, including the dimensions of the vehicle and the path to be traveled, and
wherein the path to be traveled is represented by the possible driving trajectories in the parking facilities.

* * * * *